US006338254B1

(12) United States Patent
Alsenz

(10) Patent No.: US 6,338,254 B1
(45) Date of Patent: Jan. 15, 2002

(54) REFRIGERATION SUB-COOLER AND AIR CONDITIONING DEHUMIDIFIER

(75) Inventor: Richard H. Alsenz, Missouri City, TX (US)

(73) Assignee: Altech Controls Corporation, Missouri City, TX (US)

( * ) Notice: Subject to any disclaimer, the term of this patent is extended or adjusted under 35 U.S.C. 154(b) by 0 days.

(21) Appl. No.: 09/728,656

(22) Filed: Dec. 1, 2000

Related U.S. Application Data

(60) Provisional application No. 60/168,336, filed on Dec. 1, 1999.

(51) Int. Cl.[7] ..... F25B 7/00
(52) U.S. Cl. ..... 62/79; 62/90
(58) Field of Search ..... 62/79, 93, 335, 62/238.6, 90, 173, 510

(56) References Cited

U.S. PATENT DOCUMENTS 3,165,903 A * 1/1965 Roc et al. ..... 62/90
4,819,444 A * 4/1989 Meckler ..... 62/335
5,105,633 A * 4/1992 Briggs ..... 62/90
5,686,579 A * 11/1997 Vaynberg ..... 62/335
5,953,926 A * 9/1999 Dressler et al. ..... 62/90

OTHER PUBLICATIONS

Item 001A Product Brief Hy–Dry System Introduction and Summary of Test Results.
Item 001B Effect of the Hy–Dry System on a DX Air–Conditioning Economic Analysis and Conclusions.
Item 002 Service Session Humidity Removal in Supermarkets by John Tomczyk, Reprinted from Refrigeration Service & Contracting copyright 1996.
Item 003 Leaving Humidity Hy–Dry.

* cited by examiner

*Primary Examiner*—William E. Tapolcal
*Assistant Examiner*—Mohammad M. Ali

(57) ABSTRACT

An efficient method and system for dehumidifying an environment and refrigerating a second environment with a closed loop refrigeration system consisting of compressing refrigerant with a refrigeration compressor (10) to a high temperature and pressure, condensing the high pressure refrigerant to a liquid at a high temperature, circulating high pressure refrigerant through a heat exchanger (60) which is used to transfer energy from the liquid to an environment which is being air conditioned at a higher efficiency which contains the refrigerated environment (200). The liquid is then evaporated to a gas at a low pressure in a refrigeration evaporator coil (220).

2 Claims, 6 Drawing Sheets

REFRIGERATION SUB-COOLER AND AIR CONDITIONING DEHUMIDIFIER

RELATED APPLICATIONS

The present application claims the benefit of U.S. provisional application Ser. 60/168,336 filed Dec. 1, 1999.

BACKGROUND OF THE INVENTION

1. Field of the Invention

This invention pertains to a novel method of dehumidifying an environment, which includes a refrigeration system and an air conditioning system while reducing the operational cost.

2. Description of the Related Art

Prior art systems have used refrigeration systems condensers to reheat the environment. This approach utilizes the heat which would normally be rejected to the outside environment to heat the inside environment. The Hy-Dry system sold by DTE Energy utilizes the liquid line from an air conditioning system to heat the air after it has passed over the cooling coil and air conditioning system's liquid is sub-cooled in the process. This allows the unit to discharge air at a higher temperature causing a lower net ejected humidity. Although, in this situation dehumidification may or may not take place there is no change in the coefficient of performance of the over all system other than that which is due to enlarging the heat transfer surface. That is, the same effect could be generated by simply increasing the cooling coil surface. While other prior art systems have used desiccant wheels or they have operated the reheat, which in turn causes the air conditioning to turn on and remove the moisture. In the later cases the net result is at an added operational cost.

OBJECTIVES AND ADVANTAGES OF THE INVENTION

Table of Functions, Purposes, Objectives, Goals, Tasks

| OBJECTIVE | SOLUTION |
|---|---|
| REFRIGERATION LIQUID IS SUB-COOLED | PASS AIR FROM THE CONDITIONED ENVIRONMENT OVER THE SUB-COOLING COIL OR PASS A SECONDARY FLUID OVER THE LIQUID AND THEN THROUGH THE CONDITIONED ENVIRONMENTS AND FURTHER SUB-COOL THE LIQUID WITH A HEAT EXCHANGER ON THE AIR CONDITIONER |
| LOWER ENERGY COST OF THE REFRIGERATION SYSTEM IS ACHIEVED BY REMOVING PART OF THE ENERGY AT LESS COST | SUB-COOL THE LIQUID WITH A COMPRESSOR OPERATING AT AIR CONDITIONING EFFICIENCY THE LATENT LOAD ON THE REFRIGERATION SYSTEM IS REDUCED DUE TO THE LOWER HUMIDITY IN THE REFRIGERATED ENVIORNMENT |
| DEHUMIDIFICATION IS ACHIEVED | BY HEATING CONDITIONED ENVIRONMENT AIR WITH THE WARM LIQUID AND CAUSING THE AIR CONDITIONING COMPRESSOR TO OPERATE |
| LOWER HUMIDITY IN THE DISCHARGE AIR DUCT | PASS AIR OVER THE A/C COIL FIRST AND THEN PASS THE AIR |

-continued

| OBJECTIVE | SOLUTION |
|---|---|
| WHICH RESULTS IN LESS FAVORABLE ENVIRONMENT FUNGUS GROWTH | OVER THE SUB-COOLING HEAT FOR EXCHANGER |

BRIEF DESCRIPTION OF THE DRAWING FIGURES

SUMMARY OF THE INVENTION

Figure 1:
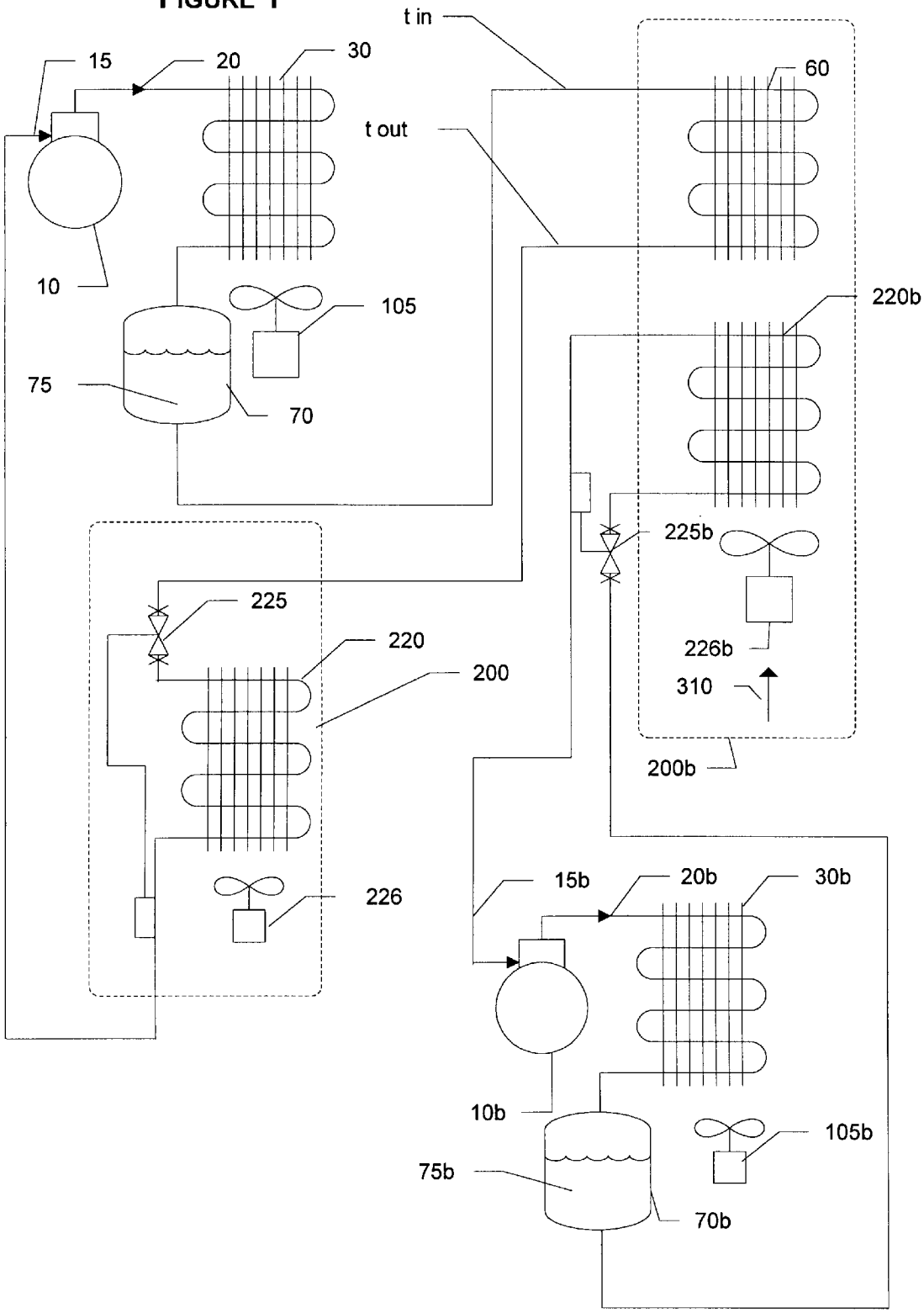
FIG. 1 is a schematic of a dehumidification sub-cooling system utilizing the current invention.

The current invention is an efficient method for dehumidifying an environment and refrigerating a second environment with a closed loop refrigeration system consisting of compressing refrigerant with a refrigeration compressor to a high temperature and pressure, condensing the high pressure refrigerant to a liquid at a high temperature, circulating high pressure liquid refrigerant through a heat exchanger which is used to transfer energy from the liquid to an environment which is being air conditioned at a higher efficiency and which may contain the refrigerated environment. The liquid is then evaporated to a gas at a low pressure in a refrigeration evaporator coil.

Elements and Functions

Table of Element and Numbers and Figures

| # | | ELEMENT DESCRIPTION | FIGURES |
|---|---|---|---|
| 10 | | REFRIGERATION COMPRESSOR | 1,2,3,4,5,6 |
| 10 | B | AIR CONDITIONING SYSTEM COMPRESSOR | 1 |
| 15 | | COMPRESSOR SUCTION | 1,2,3,4,5,6 |
| 15 | B | AIR CONDITIONING COMPRESSOR SUCTION | 1,2 |
| 20 | | COMPRESSOR DISCHARGE | 1,2,3,4,5,6 |
| 20 | B | AIR CONDITIONING COMPRESSOR DISCHARGE | 1 |
| 30 | | CONDENSER | 1,2,3,4,5,6 |
| 30 | B | AIR CONDITIONING SYSTEM CONDENSER | 1 |
| 40 | | THREE WAY VALVE | 5,6 |
| 60 | | REHEAT COIL | 1,2,3,4,5,6 |
| 70 | | RECEIVER | 1,2,3,4,5,6 |
| 70 | B | AIR CONDITIONING SYSTEM RECEIVER | 1 |
| 75 | | LIQUID REFRIGERANT | 1,2,3,4,5,6 |

-continued

| # | | ELEMENT DESCRIPTION | FIGURES |
|---|---|---|---|
| 75 | B | AIR CONDITIONING SYSTEM LIQUID REFRIGERANT | 1 |
| 80 | | CHECK VALVE | 5 |
| 81 | | CHECK VALVE | 5 |
| 105 | | REFRIGERATION CONDENSER FAN | 1,2,3,4,5,6 |
| 105 | B | CONDENSER FAN AIR CONDITIONING SYSTEM | 1 |
| 150 | | THREE WAY VALVE | 5,6 |
| 180 | | LIQUID EVACUATION SOLENOID | 5,6 |
| 200 | | REFRIGERATED AREA | 1,2,3,4,5,6 |
| 200 | B | AIR CONDITIONED SYSTEM AIR HANDLER | 1,2,3,4,5,6 |
| 200 | C | REFRIGERATED AREA C | 1,2,3,4,5,6 |
| 220 | | EVAPORATOR | 1,2,3,4,5,6 |
| 220 | B | AIR CONDITIONING EVAPORATOR | 1,2 |
| 220 | C | PARALLEL PIPED EVAPORATOR C | 2,3,4,5,6 |
| 225 | | EXPANSION VALVE | 1,2,3,4,5,6 |
| 225 | B | AIR CONDITIONING SYSTEM EXPANSION VALVE | 1 |
| 225 | C | REFRIGERATION SECOND EVAPORATOR EXPANSION VALVE | 2,3,4,5,6 |
| 226 | | EVAPORATOR FAN FOR EVAPORATOR 220 | 1,2,3,4,5,6 |
| 226 | B | AIR CONDITIONING EVAPORATOR FAN FOR EVAPORATOR 220B | 1,2,3,4,5,6 |
| 226 | C | AIR CONDITIONING EVAPORATOR FAN FOR EVAPORATOR 220C | 1,2,3,4,5,6 |
| 302 | | 303 AIR CONDITIONING SUCTION OUTLET | 3 |
| 303 | | AIR CONDITIONING SUCTION - REFRIGERATION LIQUID HEAT LIQUID HEAT EXCHANGER | 3 |
| 304 | | 303 AIR CONDITIONING SUCTION INLET | 3 |
| 306 | | AIR CONDITIONING LIQUID LINE | 1,2,3,4,5,6 |
| 310 | | AIR FLOW | 1,2,3,4,5,6 |
| 500 | | SECONDARY FLUID CIRCULATING PUMP | 4 |
| 502 | | SECONDARY FLUID HEAT EXCHANGER REFRIGERANT FLUID PATH | 4 |
| 503 | | SECONDARY FLUID HEAT EXCHANGER | 4 |

Further objectives and advantages of the invention will become apparent from a consideration of the drawings and ensuing description.

DESCRIPTION OF THE PREFERRED EMBODIMENTS

Description of FIG. 1:

In FIG. 1 a refrigeration system ejects energy from its liquid into a coil 60 located in air conditioning system air handler 200*b*. A refrigeration compressor 10 compresses a refrigerant to a high pressure and temperature discharges it through pipe 20 to condenser 30. Air is blown across condenser 30 causing the gas to condense into a liquid. Liquid 75 is accumulated in receiver tank 70. Liquid is then routed to liquid cooling coil 60 where it gives up energy and as a consequence the liquid temperature going into coil 60 is higher than the liquid temperature leaving. The refrigerant is then routed to an evaporator 200 where it is expanded through an expansion valve 225. The expanded refrigerant is warmed by air blown across evaporator 220 by fan 226. The expanded gas is routed back to compressor suction 15 where compressor 10 starts the cycle over.

The air conditioning system performs the same function of removing energy from an evaporator area 220*b* and discharging it through a condenser 30*b* at a lower compression ratio. It however does this with a higher efficiency since the level to which it must raise the compression is less than that of the refrigeration system. It also means that the cost of running the refrigeration system is less, for many reasons as will be described herein. The adding of heat to the air conditioning system has the added benefit of causing additional air conditioning operation resulting in dehumidification of the air conditioned environment. Which has cascaded benefits of producing a lower humidity in the environment of air conditioned space and the refrigeration space. This produces less latent heat load on the refrigeration systems.

Figure 2:
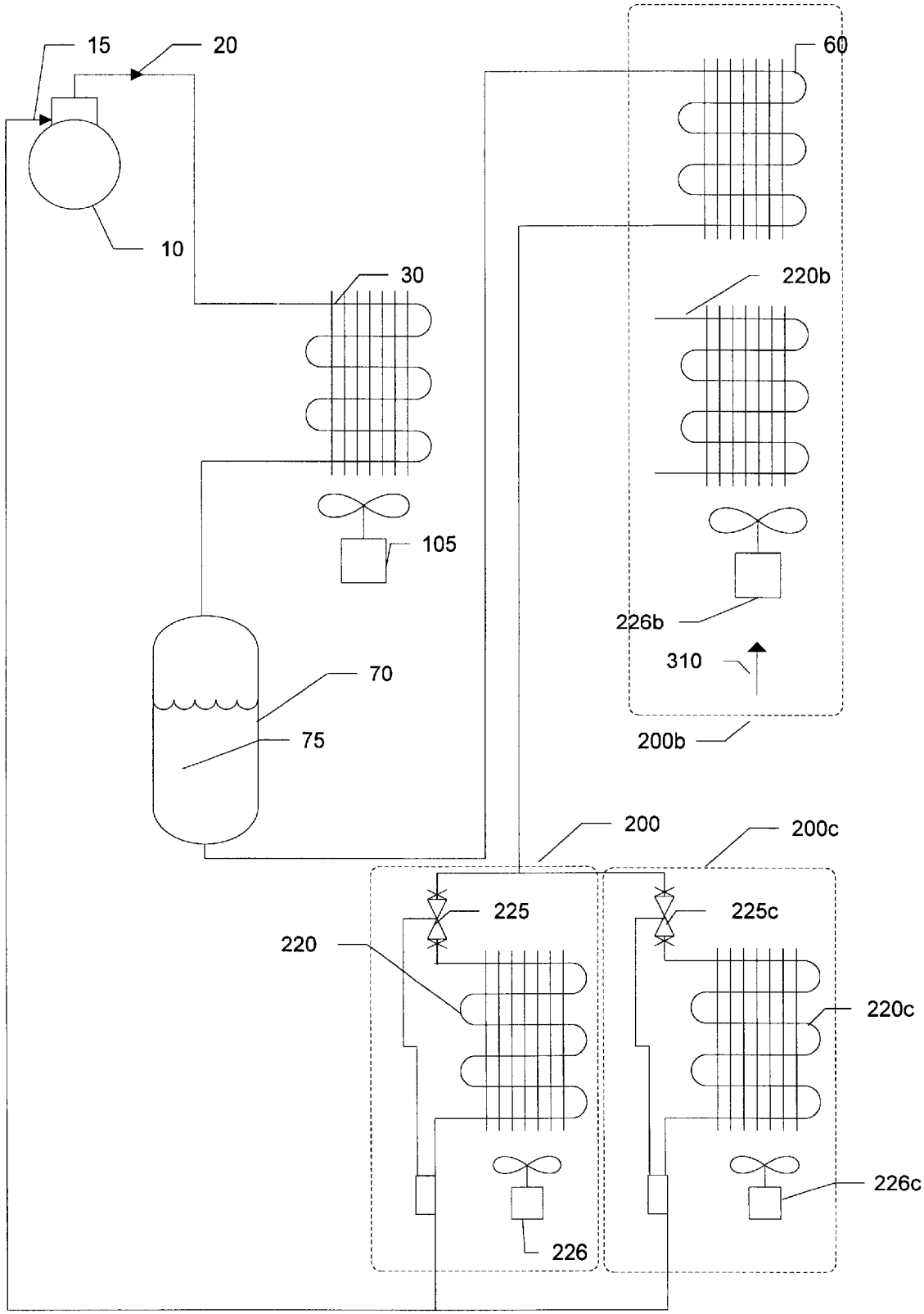
FIG. 2 is a schematic of a dehumidification sub-cooling system utilizing the current invention in which the refrigeration system has parallel piped evaporators.

Description of FIG. 2:

In FIG. 2 an additional refrigeration area 200*c* is shown which exists in parallel with refrigeration area 200. The refrigeration piping of this evaporative cooling coil system is paralleled with that of 200. The operation of the remainder of the system is identical to area 200 in FIG. 1.

Figure 3:
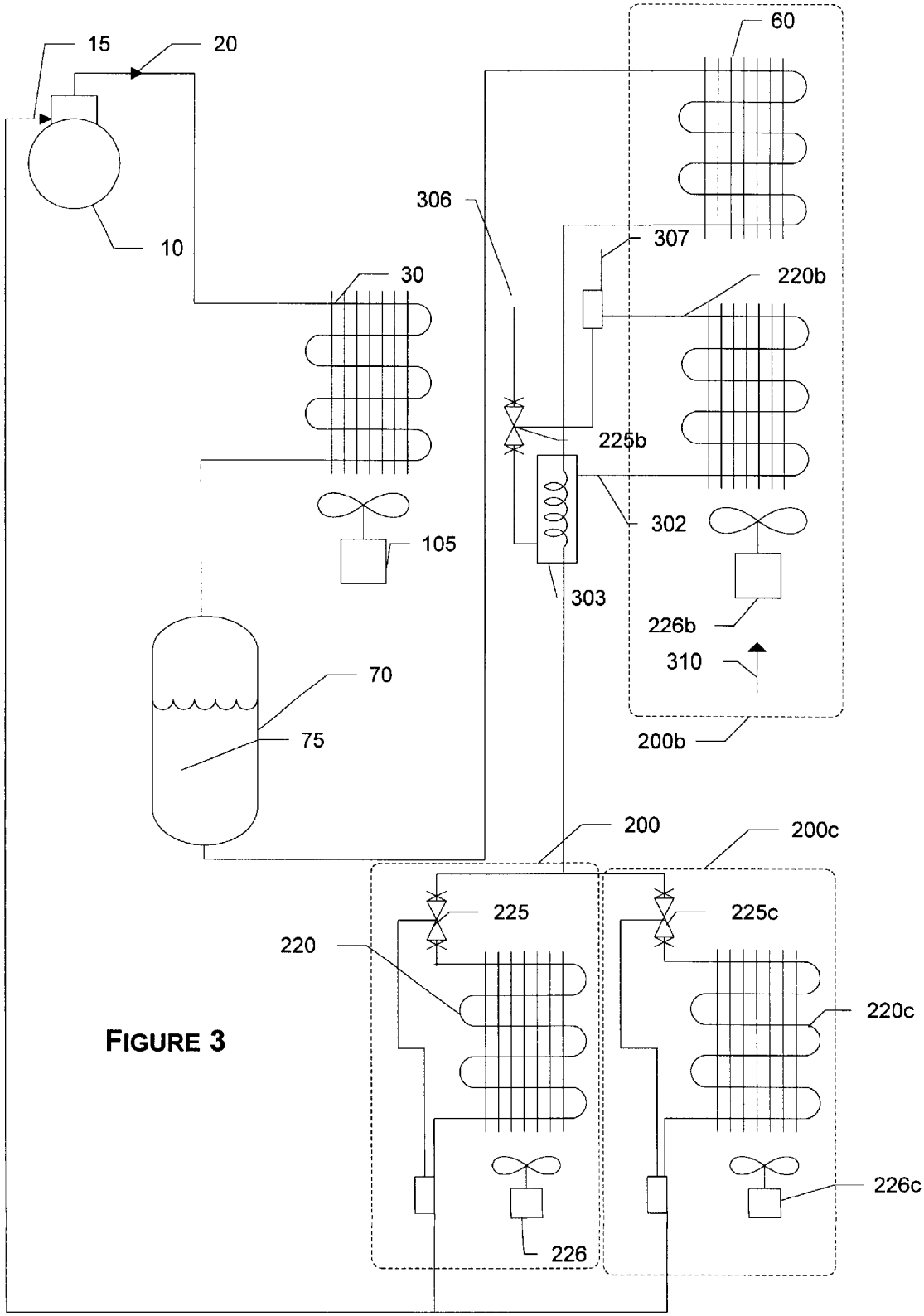
FIG. 3 is a schematic of a dehumidification sub-cooling system utilizing the current invention utilizing an additional heat exchanger on the air conditioning system to further sub-cool the refrigeration liquid.

Description of FIG. 3:

In FIG. 3 and additional heat exchanger 303 has been added to further cool the refrigeration liquid with the efficiency of the air conditioning system. The refrigerant expanded by expansion valve 225*b* is passed through the heat exchanger 303. The liquid from the refrigeration system is passed through the heat exchanger and is lowered closer to the air conditioner suction temperature. The additional energy removed from the refrigeration system liquid is now removed by the air conditioning system which is more efficient than the refrigeration system.

Figure 4:
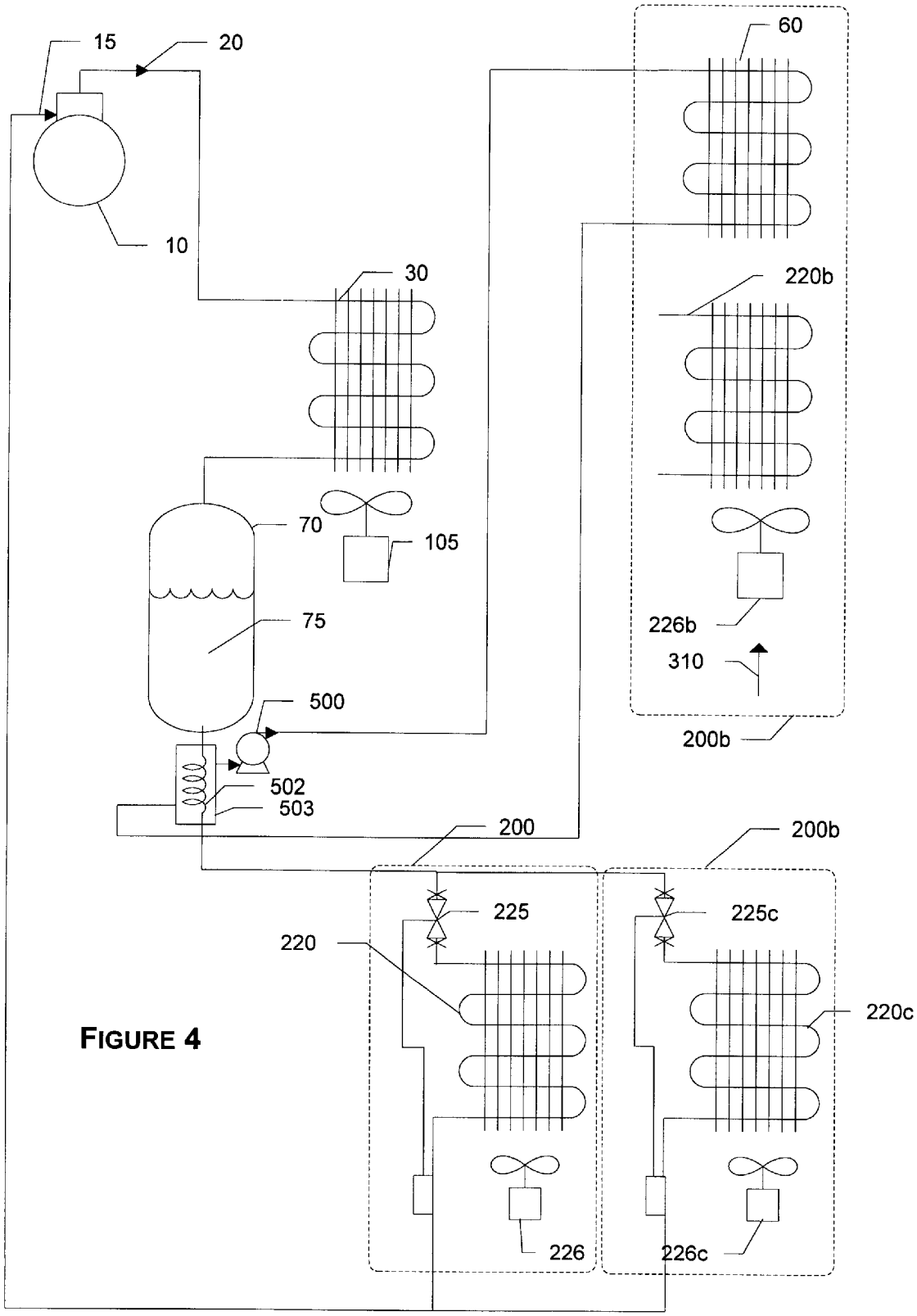
FIG. 4 is a schematic of a dehumidification sub-cooling system utilizing the current invention in which energy in refrigeration liquid is transferred to a secondary fluid prior to being discharged into the air conditioned space.

Description of FIG. 4:

In FIG. 4 a secondary fluid heat exchanger 503 is utilized to transfer energy from the refrigeration liquid to the air conditioning environment. Refrigeration liquid 75 is circulated through the secondary fluid heat exchanger 503 where energy is transferred to the secondary fluid. Secondary fluid pump circulates the fluid to air reheat exchanger 60 where the energy is transferred to the air conditioned space 200*b* for removal by the air conditioning system. It should be noted that exchanger 60 in all the figures only needs to be located in the air conditioned space to be effective. One convenient and advantageous location would be underneath one of the open (lacking doors) refrigeration fixture.

Figure 5:
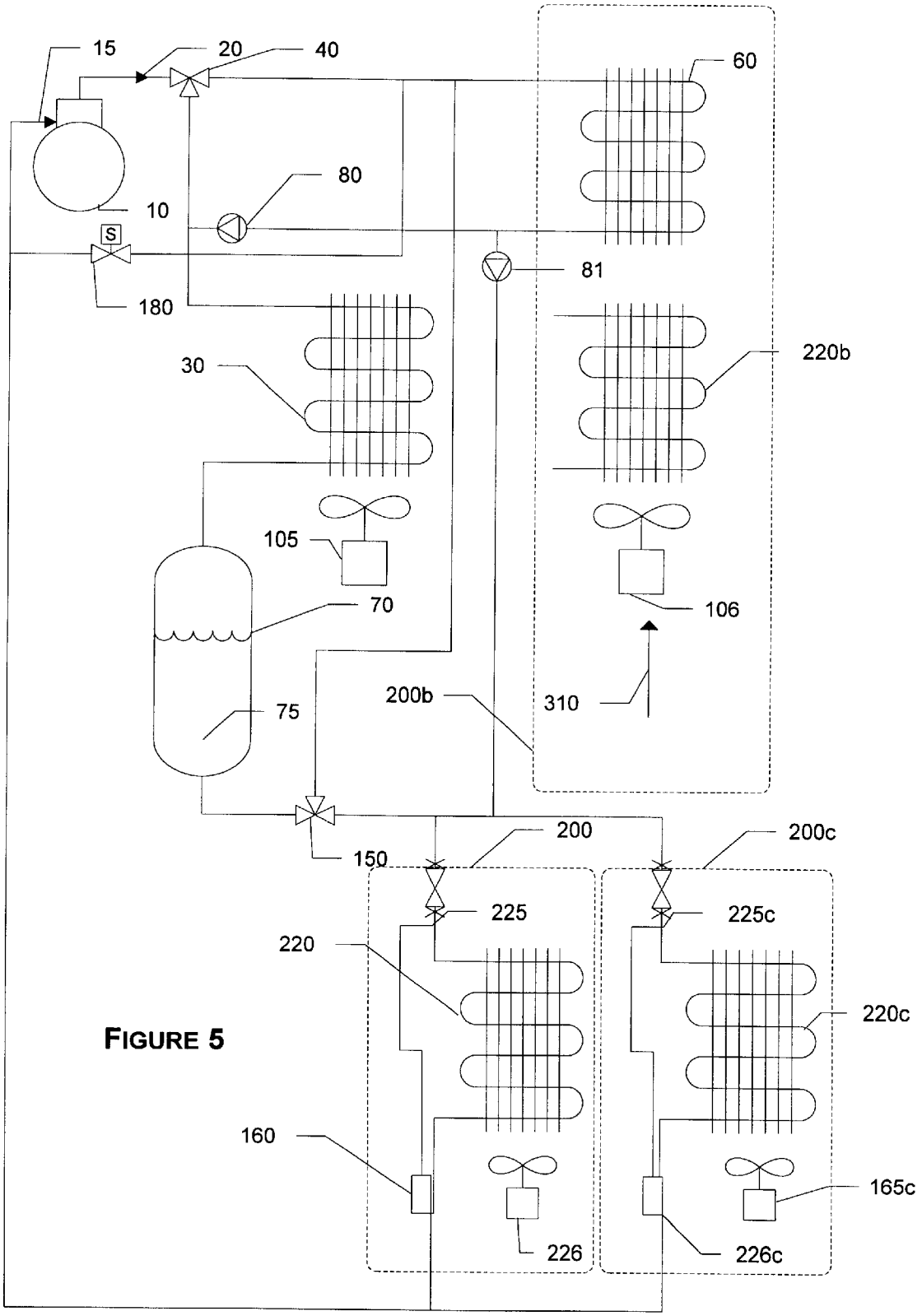
FIG. 5 is a schematic of a dehumidification sub-cooling system utilizing the current invention which includes piping for using conventional reheat.

Description of FIG. 5:

In FIG. 5 a refrigeration circuit is shown which allows for conventional hot gas reheat of the air conditioned space 200*b* in addition to the liquid cooler dehumidification system disclosed herein. When liquid cooling is required the liquid is circulated through reheat coil 60 by switching 3 way valves 40 and 150 into the appropriate positions. When full heat is required the discharge gas is circulated through reheat coil 60 positioning valves 40 and 150 into the appropriate positions.

Someone skilled in the art would be aware after reading the information contained herein that multiple refrigeration systems could have the energy from the liquid lines injected into the air conditioning system. Any refrigeration system with an efficiency which is less than the air conditioning system would produce a net efficiency gain.

While the previous description contains many specificities, these should not be construed as limitations on the scope of the invention, but rather as an exemplification of one preferred embodiment thereof. Many other variations are possible. The scope of the invention should be determined not by the embodiment(s) illustrated, but by the appended claims and their legal equivalents.

Figure 6:
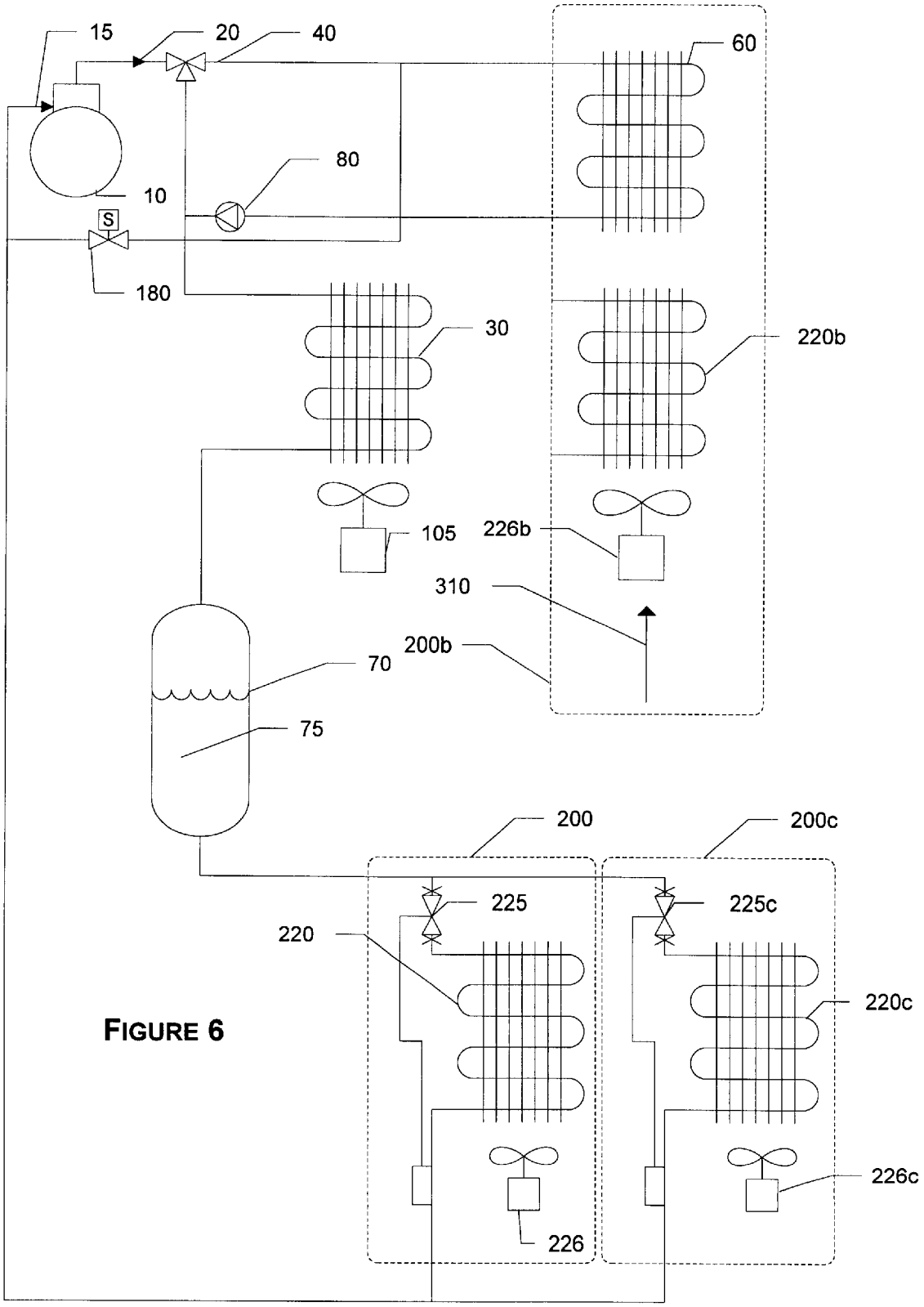
FIG. 6 is a schematic of a conventional refrigeration system used for dehumidification.

Description of FIG. 6:

A prior art system is show in FIG. 6 which allows for conventional hot gas reheat of the air conditioned space 200*b*.

What is claimed is:

1. A method for dehumidifying an environment and refrigerating a second environment with a closed loop refrigeration system consisting of:

compressing refrigerant with a refrigeration compressor to a high temperature and pressure condensing the high pressure refrigerant to a liquid at a high temperature circulating the high pressure liquid refrigerant through a coil located in an air duct which contains an air conditioning coil which is refrigerated with an air conditioning compressor which has a higher coefficient of performance than the refrigeration compressor sub-cooling the liquid by exchanging energy from the coil located in the air duct and the air circulating in the air duct evaporating the liquid refrigerant to a gas at a low pressure and temperature.

2. A method for dehumidifying an environment and refrigerating a second environment with a closed loop refrigeration system consisting of:

compressing refrigerant with a refrigeration compressor to a high temperature and pressure condensing the high pressure refrigerant to a liquid at a high temperature sub-cooling the high pressure liquid by discharging a portion of the energy contained in the high pressure liquid into a space which is air conditioned by an air conditioning system operating at a higher efficiency than the refrigeration system and removing the energy added to the air conditioned space with the air conditioning system.

* * * * *